US005819354A

United States Patent [19]

Alonso et al.

[11] Patent Number: 5,819,354

[45] Date of Patent: Oct. 13, 1998

[54] APPARATUS FOR CLEANING DUCTING

[76] Inventors: John R. Alonso; Randy V. Cannady, both of 12601 Daniger Rd., Santa Ana, Calif. 92705

[21] Appl. No.: 682,938

[22] Filed: Jul. 16, 1996

[51] Int. Cl.[6] ..... B08B 9/02

[52] U.S. Cl. ..... 15/104.05; 15/104.066; 15/104.09

[58] Field of Search ..... 15/104.05, 104.066, 15/104.067, 104.09, 104.095, 304

[56] References Cited

U.S. PATENT DOCUMENTS

| | | | |
|---|---|---|---|
| D. 289,575 | 4/1987 | Schneider . | |
| 462,156 | 10/1891 | Pederson | 15/104.09 |
| 505,761 | 9/1893 | Fludder et al. | 15/104.067 |
| 1,323,364 | 12/1919 | Clegg . | |
| 2,057,842 | 10/1936 | Nielsen . | |
| 2,544,847 | 3/1951 | Malesky . | |
| 2,813,408 | 11/1957 | Christodolu . | |
| 3,449,003 | 6/1969 | Hunt . | |
| 4,042,305 | 8/1977 | Vincent . | |
| 4,364,140 | 12/1982 | Irwin . | |
| 4,534,080 | 8/1985 | Young et al. | 15/104.066 |
| 5,369,834 | 12/1994 | Groen et al. | 15/104.09 |
| 5,383,243 | 1/1995 | Thacker . | |

FOREIGN PATENT DOCUMENTS

| | | | |
|---|---|---|---|
| 1087129 | 4/1984 | U.S.S.R. | 15/104.05 |

*Primary Examiner*—Terrence Till
*Attorney, Agent, or Firm*—Richard L. Myers

[57] ABSTRACT

A duct cleaning apparatus and method for cleaning and maintaining the interior of most types of ducts, including chimneys, air conditioning and heating ducts, dryer ducts, vents, plumbing and rain gutter ducts. The apparatus is made up of a flexible shaft connected to a cleaning brush or tool. The flexible shaft can be extended through the use of attached couplings to create an infinitely long cleaning apparatus. The cleaning brushes and tools are configured in a variety of sizes with differing configurations of bristled appendages for specific applications. At least some of the cleaning appendages are partially covered with a sleeve. In one embodiment, cleaning brushes are described for general cleaning and maintenance of ducts. In another embodiment, a tool is used to locate duct blockages. In yet another embodiment, cleaning brushes and tools are described for cleaning and maintaining chimneys, A method is also described for preparing a flexible shaft for use with the cleaning brushes and tools of the present invention.

3 Claims, 4 Drawing Sheets

FIG. 1
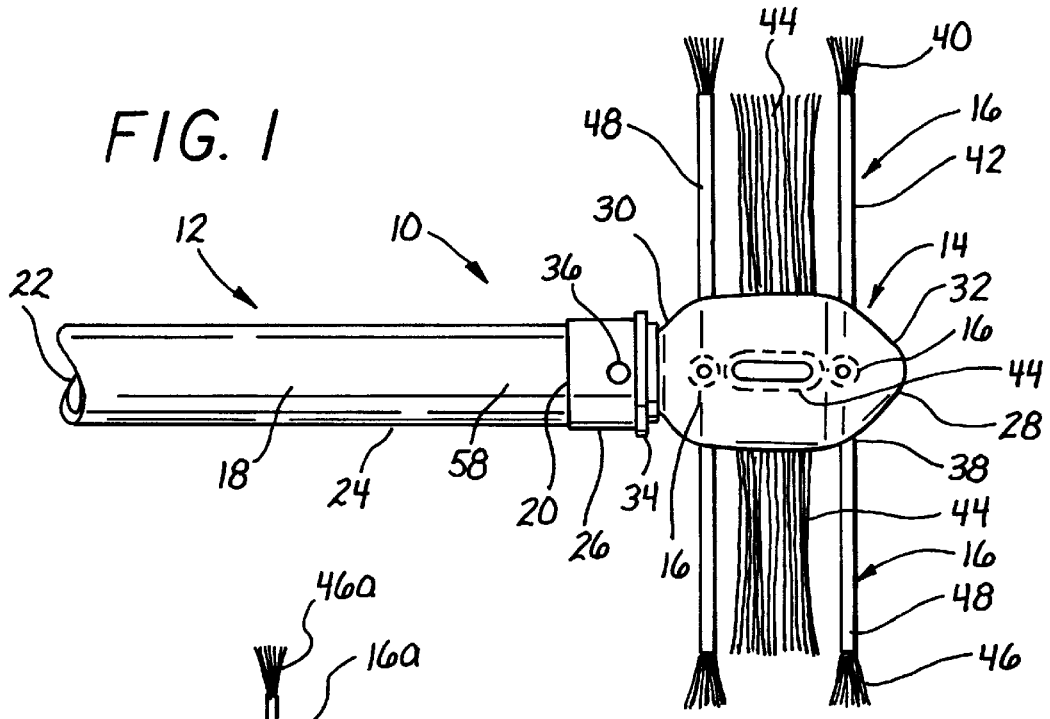
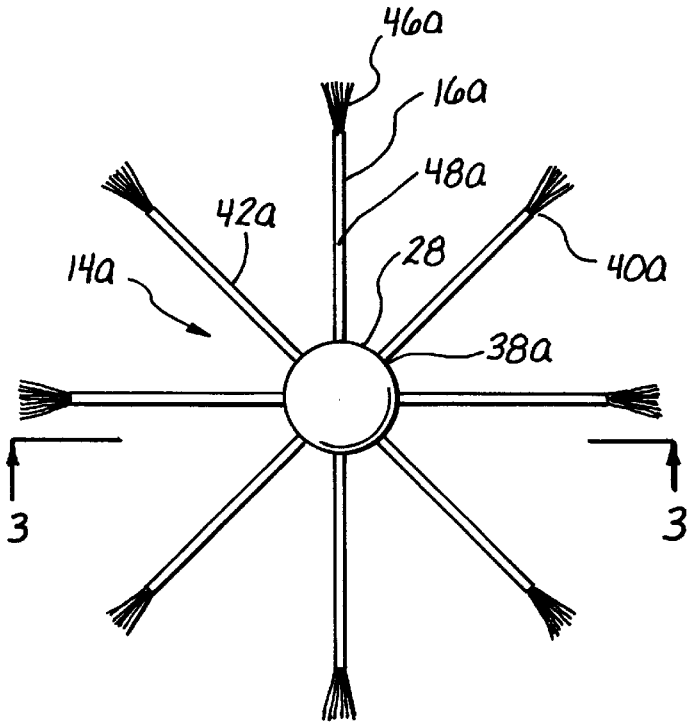
FIG. 2
FIG. 3
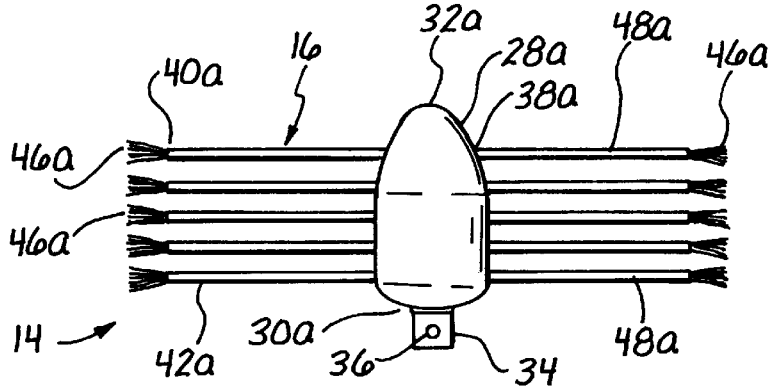

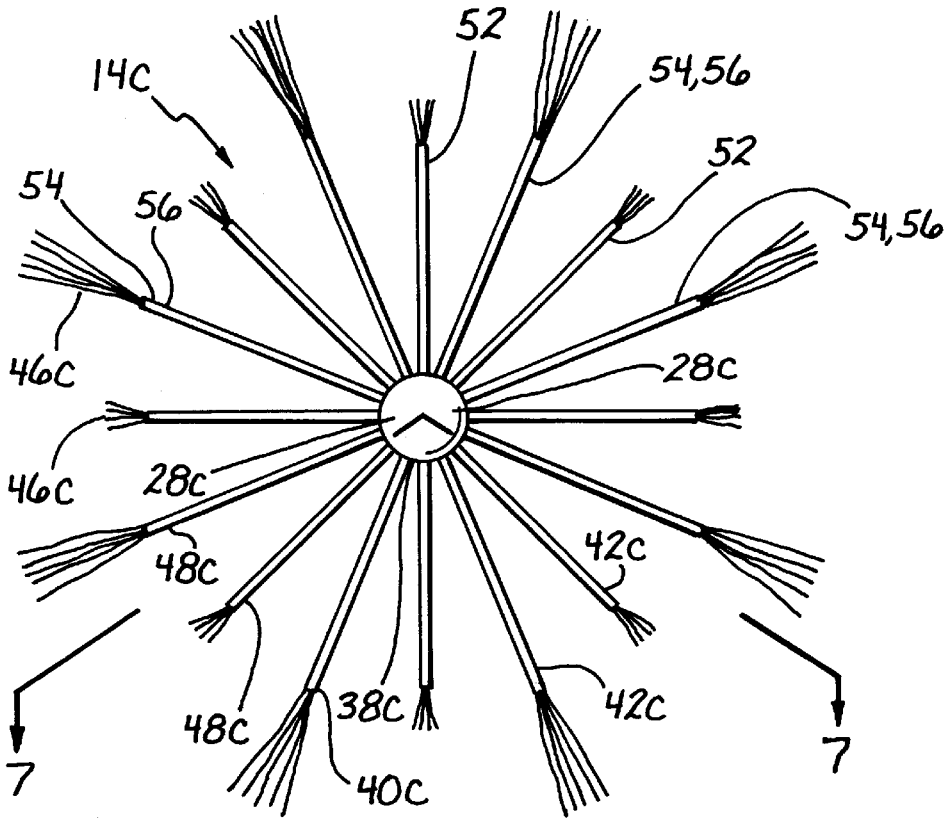
FIG. 6
FIG. 7
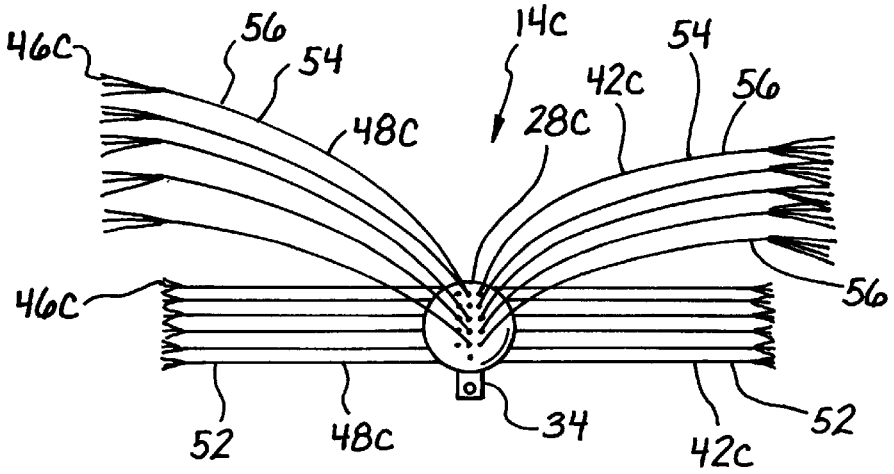

APPARATUS FOR CLEANING DUCTING

FIELD OF THE INVENTION

This invention relates generally to the cleaning of ducting and more particularly to an apparatus and method for cleaning ducting that uses specifically configured brushes and tools in conjunction with a flexible shaft.

BACKGROUND OF THE INVENTION

Devices having a shaft connected to a body configured with cleaning elements have long been used for cleaning internal tubes, ducts and chimneys. These devices are typically rotated as they are moved inside the tube, duct, or chimney, to be cleaned. However, differing types and uses of ducts have made these devices less desirable and in some situations unusable.

For example, recent advances in air conditioning and heating ducting, as well as other ducting systems, have led to the use of smaller diameter ducting as well as ducting with a thinner wall thickness. Since these ducts have smaller passageways than previous ducting, there is an increase in the chance of dirt and dust buildup, as well as an increased chance of becoming blocked. Further, since these ducts have thinner walls and are thus typically weaker, older cleaning devices may actually damage the ducts rather than clean. Thus, there is a need for a cleaning apparatus and method for cleaning and maintaining ducts, as well as for locating blockages, that is not damaging.

As another example, modern chimneys often use sheet metal ducts instead of the traditional steel or concrete flues. This is particularly true for the smaller fireplaces that are designed to burn small compressed wood logs. These chimney ducts are often smaller in diameter than their typical wood log burning flues and may have a number of bends which may be more susceptible to dangerous clogging and resin buildup. The use of traditional chimney sweeps and chimney cleaning tools often do not work in the smaller ducts and can damage the thin walls of the ducting. Thus, there is a need for a cleaning apparatus and method for cleaning chimneys having duct flues.

An additional problem encountered in chimney ducts as well as in air conditioning, heating and other ducting, occurs when two ducts of differing diameter meet. Previous duct cleaning tools where not very effective or required cleaning the duct from both ends and using two different size cleaning heads. This was particularly true if the difference in ducting diameters was more than slight. Additionally, cleaning from both ends is not always possible. Thus, there is a need for a duct cleaning apparatus and method for cleaning ducting that has different diameters.

Existing duct cleaning devices include cleaning tools which have wire brush ends. A problem with these wire brushes generally occurs at the brush ends and particularly, when used in larger diameter duct applications. For example, the shafts of the brush wires must be stiff enough to create a brush effective for cleaning, but not so stiff that the wires damage the duct. Larger diameter ducts require a stiffer wire shaft to support the bristles out at the walls of the duct. However, these stiffer shafts mean larger diameter wires which are less flexible and tend to damage the ducts. Also, differing applications may call for a different brush stiffness in a similar duct diameter. Thus, there is a need for a duct cleaning tool that can provide differing brush stiffness at the walls of similar diameter ducts.

Additionally, a recent increase in the use of ducts has lead to an increased need for duct cleaning and maintenance tools and methods. For example, modern dryer ducts or vent systems can trap lint and become a fire hazard. Stoves and furnace ducts or vents may have similar problems. All of these ducts may potentially become clogged by lint, dirt, animal waste or nests. These clogs must be located and then cleaned out.

What is needed therefore is a duct cleaning apparatus and method that can clean and maintain modern ducts and ducting systems without causing damage. This duct cleaning apparatus and method should be able to locate and clean out blockages as well as effectively clean a continuous duct of two differing diameters. The ducting cleaning apparatus and method should be relatively simple to use and inexpensive.

SUMMARY

The present invention satisfies the need for a duct cleaning apparatus and method that effectively cleans and maintains the interior of ducting without causing damage. By providing cleaning tools which have a number of flexible cleaning appendages, in various combinations, and in conjunction with a flexible drive shaft, continuous ducts with changing diameters can be effectively cleaned. These flexible cleaning appendages also allow for the entry and cleaning of a variety of types and sizes of ducts.

By further providing duct cleaning tools which have flexible appendages that are supported by flexible sleeves, bristled ends of varying stiffness can be provided at the walls of the ducting. By varying the amount of sleeve covering the bristled end, the stiffness of the bristled end is changed.

The present invention is generally directed to an apparatus and method for cleaning and maintaining ducts. In one broad aspect, a duct cleaning apparatus is provided comprising a flexible shaft which has a first end, a second end and an axis. The first end of the shaft is fitted with a first coupling half.

A base member is also provided which has an upper end and a lower end. The lower end of the base member is fitted with a second coupling half. The base member is coupled to the flexible shaft through connection of the first and second coupling halves.

A plurality of cleaning appendages which have a proximal end, a distal end, and an appendage length are attached to the base member at their proximal ends. The cleaning appendages extend outwardly from the base member, generally perpendicular to the axis of the flexible shaft.

At least a portion of the cleaning appendages are made from a plurality of wires or other bristles which have ends that are spread out and exposed at the distal ends. These exposed individual wires or bristles form a bristled end for contact with the inner walls of the duct to be cleaned and maintained.

Methods for making a flexible shaft assembly for use with duct cleaning and maintenance tools, for example the presently described apparatus, are included within the scope of the present invention. In general, such methods comprise providing a flexible shaft which has a proximal end and a distal end. The flexible shaft is inserted into a cylindrical tube which is made from a flexible material. A first coupling half is then attached to the distal end of the flexible shaft such that a duct cleaning tool can be coupled to the shaft in a removable fashion.

The invention, together with additional features and advantages thereof, may be best understood by reference to the following description taken in conjunction with the accompanying illustrative drawings.

BRIEF DESCRIPTION OF THE DRAWINGS

FIG. 1 is a perspective view of a duct cleaning apparatus according to the present invention;

FIG. 2 is a top view of an embodiment of a cleaning brush in accordance with the present invention;

FIG. 3 is a cross sectional view taken along lines 3—3 of FIG. 2;

FIG. 6 is a top view of an embodiment of the present invention showing a cleaning brush;

FIG. 7 is a cross sectional view taken along lines 7—7 in FIG. 6;

DETAILED DESCRIPTION

Figure 4:
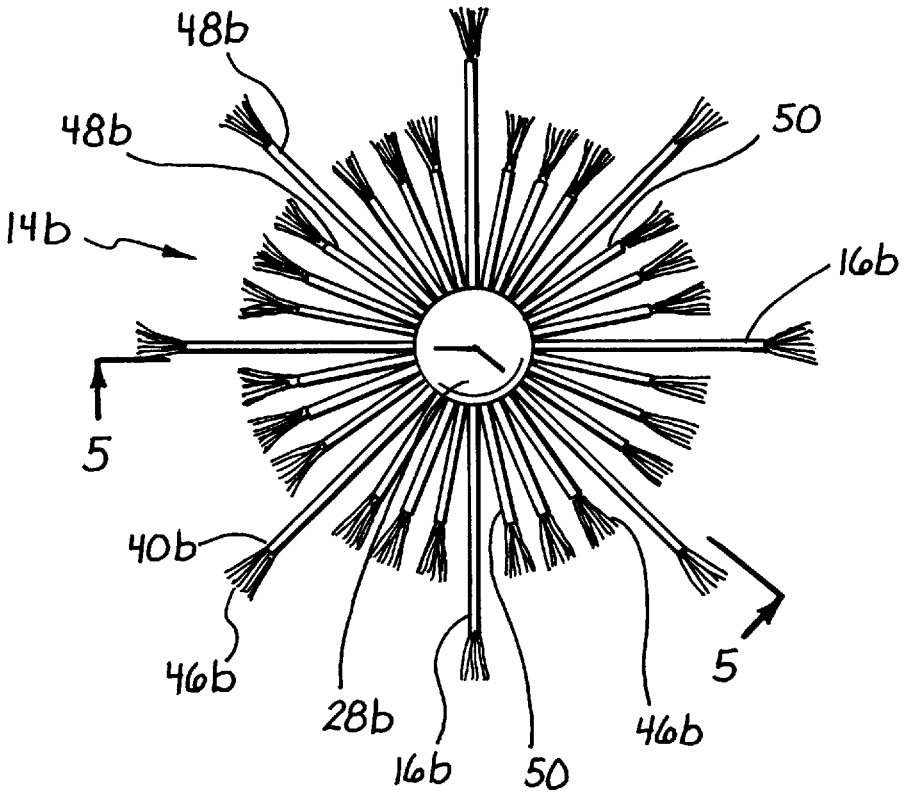
FIG. 4 is a top view of an embodiment of the present invention showing an alternative cleaning brush.

Referring to the drawings and particularly to FIG. 1, the basic duct cleaning apparatus of the present invention is shown. The duct cleaning apparatus 10 preferably includes a flexible shaft assembly 12 and a duct cleaning tool 14. The duct cleaning tool 14 has a number of independent cleaning appendages 16 for contacting the inside walls of the duct (not shown).

The flexible shaft assembly 12 generally includes a shaft 18 having a first end 20, a second end 22 and an axis generally extending along its straightened length. The shaft 18 may made from flexible wire in any flexible form such as a helical wire shaft or a snake, but may be any flexible shaft or rod which can be pushed inside a length of duct (not shown) while rotating the duct cleaning tool 14. In a preferred embodiment, the shaft 18 is 5/16 inch diameter heavy duty hardwire or music wire that is coiled. The flexible shaft assembly 12 is generally connected to a rotation means (not shown) which may include a drill, rotor motor, or the like.

The flexible shaft assembly 12 may a leader segment (not shown). This leader segment (not shown) is generally a very flexible member for navigating the curved sections of ducts and is particularly useful in dryer ducting. This leader segment may be 5/16 inch loose intercore cable, but any cable of similar flexibility may be used. The leader segment may be a separate flexible shaft assembly 12 or may be an individual leader segment piece (not shown).

The flexible shaft assembly 12 may include a cylindrical covering 24. The cylindrical covering 24 is a generally flexible sheath or tubing material which fits over the shaft 18 and protects the shaft 18, the walls of the duct as well as the hands, hair and clothing of the user (not shown). The cylindrical covering 24 may be made from a tube of flexible material such as urethane, plastic, teflon, rubber, shrink fit tubing, or similar. Alternatively, the cylindrical covering may be a flexible coating that is sprayed or otherwise applied to the shaft 18.

The flexible shaft assembly 12 may be colored. Preferably, a paint is applied to at least a portion of the interior or exterior of the cylindrical covering 24, but any other method of coloring the flexible shaft assembly 12 may be used. For example, the shaft 18 may be painted or colored. This is particularly useful if the cylindrical covering 24 is not used, is clear, or for any portion of the shaft 18 not covered by a colored cylindrical covering 24. Alternatively, an integrally colored cylindrical covering 24 could be used. The cylindrical covering 24 may also be left clear.

The flexible shaft assembly 12 may also include a half coupling 26 attached to the first end 20 of the shaft 18. The half coupling 26 may be fitted with a beveled release hole (not shown). The half coupling 26 is generally configured to allow removable connection with a duct cleaning tool 14. The half coupling 26 also acts to prevent the cylindrical covering 24 from sliding forward on the shaft 18, forward of the first end 20. Alternatively, the flexible shaft assembly 12 may be directly connected to a duct cleaning tool 14.

The flexible shaft assembly may also include a label 28 or other marking. The label 28 may be used to identify the duct cleaning apparatus 10, provide instructions, or identify the supplier. The label 28 is preferably attached around the shaft 18. A clear portion of the cylindrical covering 24 may cover the label 28 to provide protection.

A duct cleaning tool 14 is connected to the flexible shaft assembly 12. The duct cleaning tool 14 generally has a base member 28 and a plurality of cleaning appendages 16. The base member has a lower end 30 and an upper end 32. A half coupling 34 may be attached to the lower end 30 of the base member 28. The half coupling 34 is configured to couple with the half coupling 26 attached to the first end 20 of the flexible shaft assembly 12. The half coupling 34 attached to the base member 28 may be fitted with a push button release 36. However, any type of removably mounting the lower end 30 of the base member 28 to the first end 20 of the flexible shaft assembly 12 may be used, such as a ball detent assembly, a shaft and pin assembly, or similar. Alternatively, the lower end 30 of the base member 28 may be directly attached to the first end 20 of the shaft assembly 12.

Cleaning appendages 16 are attached to the base member 28 between the lower end 30 and the upper end 32. The cleaning appendages 16 have a proximal end 38, a distal end 40 and a length 42. Cleaning appendages 16 are attached to the base member 28 at the proximal ends 38 and extend outwardly in a direction generally perpendicular to the axis of the flexible shaft assembly 12. However, cleaning appendages 16 may extend outward from the base member 28 in other directions.

At least some of the cleaning appendages 16 are groups of wires or cables which are spread and bristled at their distal ends 40. These cleaning appendages 16 may be unsheathed twisted wires with their distal end 40 ends untwisted to make a bristled end 46. The appendages 16 may also be unsheathed braided or straight wire cables or groupings, or the like, with their ends spread and bristled. The appendages 16 may also be made from any material or grouping of material capable of supporting a bristled end 46, such as plastics or synthetic members. In a preferred embodiment, the cleaning appendages 16 are made from seven strand braided aircraft cable. However, any number of strands will work. The cable may be galvanized or stainless steel.

Cleaning appendages 16 may also be configured with a shaft or other extending support member(not shown) in connection with wire bristles or other bristles to create a bristled end 46. The diameter of the wire or bristles may be increased for stiffness or, for a larger diameter cleaning tool 14, or may be decreased. An alternative to wire may include plastic, or other hard material which can be made into bristles.

In addition to the cleaning appendages 16, tightly spaced groupings of single bristle appendages 44 may also be included. These single bristles appendages 44 may be stiff wire pieces, sheathed wire pieces, synthetic bristles, or similar. The single bristle appendages 44 are grouped together to form broom-like members. The single bristle appendages 44 may be attached around the base member 28 between the cleaning appendages 16.

The cleaning appendages 16 may be covered with a sleeve 48. The sleeve 48 generally acts to extend the bristled ends 46 of the cleaning appendages 16 away from the base member 28 so that they may contact the wall of the duct (not shown). The sleeves 48 allow for a longer extension of the cleaning appendage 16 away from base member 28 without the loss of stiffness at the bristled ends 48 that may otherwise occur.

The sleeves 48 may extend from the base member 28 to the distal end 40, leaving an exposed bristled end 46 of the cleaning appendage 16. In this fashion, differing lengths of bristled ends 46 may be fashioned by adjusting the length of the sleeve 48 on the distal end 40. Instead of one long sleeve 48, a number of short sleeves, weldments, bands or rings may be used (not shown). In general, the sleeve 48 may extend from adjacent to the base member 28 outwardly to a distance approximately 65 to 95 percent of the length 42 of cleaning appendage 16. However, the sleeve may include rings or bands (not shown) with the last ring or band located at approximately 65 to 95 percent of the length 42.

The stiffness and flexibility of the bristled end 46 is directly related to its length. This length is adjusted by adjusting the distance the sleeve 48 extends outward along the distal end 40. Thus, cleaning appendages 16 of differing stiffness and flexibly may be made by adjusting the length of the sleeve 48 along the cleaning appendage 16. The sleeve 48 may also act to retain the cleaning appendage 16 as a shaft and not as a group of bristles.

Using different length appendages 16 allows a duct cleaning tool 14 to effectively clean the curves and bends in the ducting. A duct cleaning tool 14 having a first annular ring of cleaning appendages 16 which may be used to clean the general diameter of the duct and a second set of annular rings that are longer acts to effectively clean curves and bends. The longer flexible appendages 16 may trail behind ta first set of duct cleaning appendage 16 and clean curves, bends and even be used to clean chimney covers or spark arresters.

The sleeve 48 may be made from heat shrink tubing, or a liquid dip plastic. However rubber, resins, other plastics or any other similar tight fitting sleeve material may be used. In the alternative, sheathed wires may be used as the cleaning appendage 16 with the sheath acting as the sleeve 48.

Referring now to FIGS. 2–9, specific embodiments of the duct cleaning tool 14 of the present invention will be described. These embodiments have different configurations of cleaning appendages 16 for cleaning and maintaining different types of ducting. For example, the cleaning of chimney ducts requires a generally different cleaning tool than required for removing dust from an air conditioning and heating duct. In addition, embodiments of the present invention includes duct cleaning tools for locating duct blockages and for cleaning specially shaped ducts. Thus, the following description will describe a number of different embodiments of duct cleaning tools as contemplated by the present invention. However, the invention is not indented to be limited to the specific embodiments shown or described. In addition, the duct cleaning tools 16 are not limited to a certain diameter or type of duct but can be adjusted to fit the desired duct size and type without deviating from the scope or spirit of the present invention.

The following embodiments generally encompass the aspects described above such that like numbers will be used to designate generally like parts. However it is to be understood that like parts may have slightly different configurations in differing embodiments without deviating from the scope of the invention.

Referring now to FIGS. 2 and 3, an embodiment of a duct cleaning tool of the present invention generally used to clean ducts will be described. In one broad aspect, the duct cleaning tool 14*a* generally includes a plurality of annular rows of cleaning appendages 16*a* attached to the base member 28*a*. The rows of cleaning appendages 16*a* are generally evenly spaced apart along the base member 28*a* between the lower end 30*b* and the upper end 32*b*.

The cleaning appendages 16*a* of each of the rows are generally lined to form columns which are generally parallel to the axis of the flexible shaft assembly 12. These columns are generally equally spaced apart around the base member 28*b*. The rows are generally spaced closer together than the columns. In one specific aspect, there may be 5 rows spaced around the base member 28*a* with each row having 8 cleaning appendages 16*b*. However, any number of rows that can reasonably fit on the base member 28*b* may work. In a similar fashion, any number of cleaning appendages 16*a* per row may be used. Each of the cleaning appendages 16 may be fitted with equal length sleeves 48. However, variations in sleeve length may be used.

Figure 5:
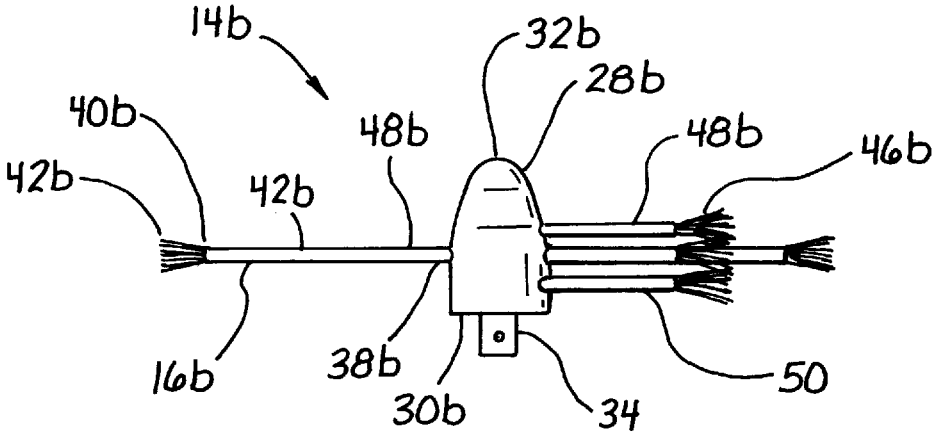
FIG. 5 is a cross sectional view taken along lines 5—5 in FIG. 4.

Referring now to FIGS. 4 and 5, an embodiment of a duct cleaning tool of the present invention generally used to clean ducts will be described. In one broad aspect, the duct cleaning tool 16*b* includes a first set of generally equal length cleaning appendages 16*b* which are equally spaced around base member 28*b*.

The duct cleaning tool 14*b* may also include a second set of equal length appendages 50. These appendages 50 generally include a plurality of groupings of equal length appendages which are evenly spaced around the base member 28*b* between said first set of appendages 16*b*. The second set of appendages 50 are generally tightly spaced and are shorter length than said first set of cleaning appendages 16*b*. The second set of appendages 50 may extend outwardly, perpendicular to the axis of the flexible shaft assembly 12 in similar fashion to the first set of cleaning appendages 16*b*. The second set of appendages 50 may include groupings of 3 appendages 50 each, but any number may be used.

The cleaning appendages 16*b* and 50 may be fitted with sleeves 48. The sleeves 48 preferably extend further along the length 42 of the first cleaning appendage 16*b* than along the second cleaning appendages 50 such that the first cleaning appendages 16*b* have a generally shorter bristled end 46 than the second cleaning appendages 50.

Referring now to FIGS. 6 and 7, an embodiment of a duct cleaning tool of the present invention generally used to clean ducts and particularly, chimney ducts, will be described. In one broad aspect, the duct cleaning tool 14*c* generally includes a plurality of first annular rows 52 of generally equal length cleaning appendages 16*c* which extend outwardly, generally perpendicular to the axis of the flexible shaft assembly 12. The rows 52 are generally equally spaced around the base member 28*c* between the lower end 30*c* and the upper end 32*c*.

Each row 52 includes a plurality of cleaning appendages 16*c* equally spaced apart around the base member 28*c*. In one specific aspect, there may be 8 cleaning appendages 16*c* in each row 52 rows and a total of 6 rows 52. However, any number of rows 52 may work equally well. In a similar fashion, any number of cleaning appendages 16*c* per row 52 will work.

A plurality of second annular rows 54, each having a plurality of second cleaning appendages 56 are attached to the base member 28*c*. The plurality of second cleaning appendages 56 are generally equal length and extend outwardly and upwardly from the base member 28*c*. The second cleaning appendages 56 of each of the second annular rows 54 are each equally spaced apart around the base member 28*c* between cleaning appendages 16*c*.

Each of the plurality of second annular rows 56 is generally equally spaced apart along the base member 28*c* between the lower end 30*c* and the upper end 32*c*. In one specific aspect, there may be 8 second cleaning appendages 56 in each second annular row 54 and a total of 5 second annular rows 54. However, any number of second annular rows 54 is possible. In a similar fashion, any number of cleaning appendages 56 per row 56 is possible.

Both the cleaning appendages 16*c* and the second cleaning appendages 56 may each be fitted a sleeve 48*c*. The sleeves 48*c* may be of differing length such that the second cleaning appendages 56 have a longer bristled end 46*c* than the cleaning appendages 16*c*.

Figure 8:
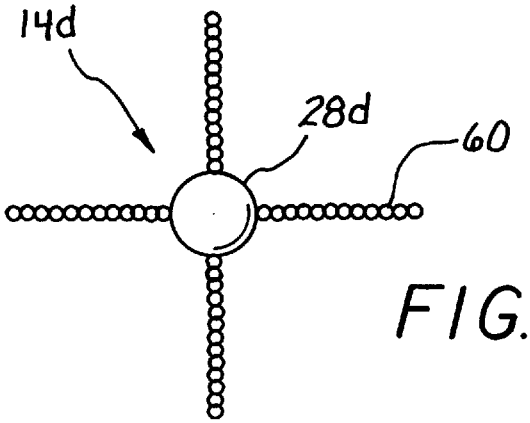
FIG. 8 is a top view of an embodiment of the present invention showing a duct blockage locating tool.

Referring now to FIG. 8, an embodiment of a duct cleaning tool of the present invention generally used to located obstructions in ducts will be described. In one broad aspect, the duct cleaning tool 14*d* has a base member 28*d* which may be spherically shaped. The base member 28*d* has a plurality of appendages 16*d* attached between the lower and upper ends 30*d* and 32*d*. The appendages 16*d* are preferably evenly spaced around the base member 28*d* and are capable of extending perpendicularly to the axis of the flexible shaft 12.

The appendages 16*d* are preferably lengths of chain 60, but may be other types of loose assemblies, linkages, or similar which have sufficient length such that they generate noise when travelling down an unobstructed duct. In a preferred embodiment, four equal lengths of chain 60 are used. The appendages 16*d* are designed to generate less noise or a different type of noise when encountering an obstruction in the duct.

Figure 9:
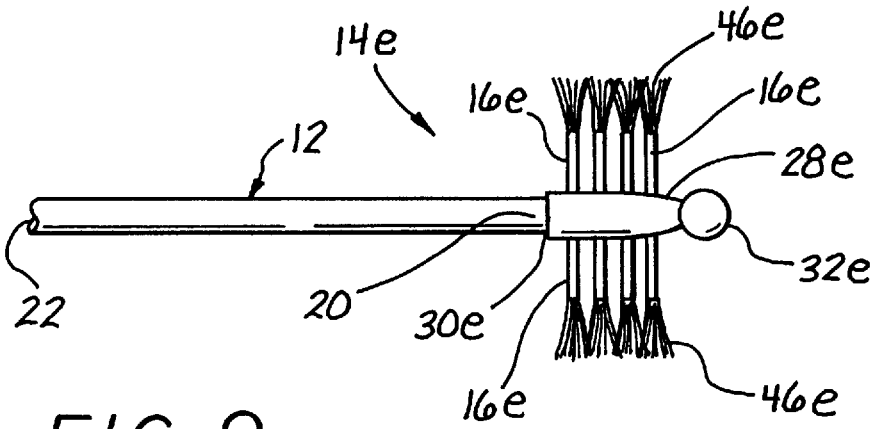
FIG. 9 is a side view of an embodiment of the present invention showing a lint trap cleaning brush.

Referring now to FIG. 9, an embodiment of a duct cleaning tool of the present invention used to clean and clear lint traps and small ducts will be described. In one broad aspect, the duct cleaning tool 14*e* includes a plurality of cleaning appendages 16*e* which may be short lengths of bristles members such as twisted wire, cables, or the like. The appendages 16*e* are generally passed through small holes in the base member 28*e* which run perpendicular to the axis of the base member 28*e* and are fanned out or bristled 46*e* as described above. The cleaning appendages 16*e* extend from the base member 28*e* in a single plane. The holes act to support the appendages 16*e* and to attach them the base member 28*e*. The cleaning tool 14*e* may include 4 lengths of cleaning appendages, however any number that can pass through the required duct is acceptable.

Again, referring to FIG. 1, a method of making a flexible shaft assembly for use with duct cleaning and maintenance tools, as generally described in this application, will be described. A shaft 18 is provided which has a first end 20, and a second end 22. The shaft may have a generally uniform outer diameter. The shaft 18 is inserted into a cylindrical covering 26 such that at least a portion of the shaft 18 is covered.

The cylindrical covering 26 is generally a flexible tube as described above. To ensure a tight fit around the shaft 18, the cylindrical covering 26 may be expanded prior to the insertion of the shaft 18. The covering 26 may be expanded by blowing compressed air through it, by application of heat, or by any means that allows for a general expansion cover 26. The cylindrical covering 24 may also be made from a shrinkable material, such as heat shrink tubing and shrunk after the shaft 18 has been inserted.

The shaft 18 may be painted or otherwise colored prior to insertion into the covering 24. However, the interior or exterior of the cylindrical covering 24 may also be painted or colored.

A half coupling 26 is attached to the first end 20 of the shaft 18. The coupling half 26 may be attached through welding, screw type fittings or the like. The half coupling 26 removably connected to a generally opposing half coupling 34 attached to the base member 14 of a duct cleaning tool 14 as described above.

A second coupling half (not shown) is attached to the second end 22 of the flexible shaft assembly 12. This second half coupling is generally an opposing half coupling to the half coupling 26. In this way, a continuous flexible shaft may be configured from a plurality of flexible shafts 12 coupled between their respective first half couplings 26 and second half couplings. The half couplings may also act to restrain the cylindrical covering 24 from coming off of the shaft 18.

A label 58 may be applied to the shaft 18 prior to covering the shaft with the cylindrical covering 18 such that the label 58 is retained and protected. The label 58 may be used to indicated the product name, the manufacturer, or similar information.

While this invention has been described with respect of various specific examples and embodiments, it is to be understood that the invention is not limited thereto and that it can be variously practiced within the scope of the following claims.

What is claimed is:

1. An apparatus for cleaning and maintaining ducts, comprising:

a flexible shaft having a first ends a second end and an axis;

a base member having a upper end and a lower end, said base member removably connected to the first end of said flexible shaft;

at least one cleaning appendage having a proximal end, a distal end, and an appendage length, the proximal end of the cleaning appendage being attached to the base member and extending outwardly of the base member generally perpendicular to the axis of the flexible shaft;

a plurality of wires included in the at least one cleaning appendage, the wires having ends that are spread out and exposed at the distal end of the cleaning appendage forming a bristled end of the cleaning appendage for contact with the inner walls of the duct to be cleaned and maintained;

a sleeve surrounding at least a portion of the cleaning appendage and extending essentially from the proximal end of the appendage to the base member outwardly to about 70 to 95 percent of the appendage length and wherein the remaining 5 to 30 percent of the appendage length at the distal end is exposed.

2. An apparatus for cleaning and maintaining ducts, comprising:

a flexible shaft having a first end, a second end and an axis;

a base member having a upper end and a lower end, said base member removably connected to the first end of said flexible shaft;

at least one cleaning appendage having a proximal end, a distal end, and an appendage length, the proximal end of the cleaning appendage being attached to the base member and extending outwardly of the base member generally perpendicular to the axis of the flexible shaft;

a plurality of wires included in the at least one cleaning appendage, the wires having ends that are spread out and exposed at the distal end of the cleaning appendage forming a bristled end of the cleaning appendage for contact with the inner walls of the duct to be cleaned and maintained;

a sleeve surrounding at least a portion of the cleaning appendage, the sleeve being formed of shrink tubing.

3. An apparatus for cleaning and maintaining ducts, comprising:

a flexible shaft having a first end, a second end and an axis;

a base member having a upper end and a lower end, said base member removably connected to the first end of said flexible shaft;

at least one cleaning appendage having a proximal end, a distal end, and an appendage length, the proximal end of the cleaning appendage being attached to the base member and extending outwardly of the base member generally perpendicular to the axis of the flexible shaft;

a plurality of wires included in the at least one cleaning appendage the wires having ends that are spread out and exposed at the distal end of the cleaning appendage forming a bristled end of the cleaning appendage for contact with the inner walls of the duct to be cleaned and maintained;

a sleeve surrounding at least a portion of the cleaning appendage wherein the sleeve is flexible.

* * * * *